US007866083B2

(12) United States Patent
Teetzel

(10) Patent No.: US 7,866,083 B2
(45) Date of Patent: Jan. 11, 2011

(54) MODULAR FLASHLIGHT APPARATUS FOR FIREARM

(75) Inventor: James W. Teetzel, York, ME (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 11/591,886

(22) Filed: Nov. 1, 2006

(65) Prior Publication Data

US 2008/0134562 A1 Jun. 12, 2008

(51) Int. Cl.
*F41G 1/00* (2006.01)
*G01S 13/78* (2006.01)

(52) U.S. Cl. ..... 42/146; 42/114; 42/117; 362/110; 362/191; 342/45

(58) Field of Classification Search ..... 42/114, 42/117, 146, 113, 14, 115, 123, 124, 131, 42/191; 362/110, 114, 112, 113, 197, 198, 362/199; 342/45
See application file for complete search history.

(56) References Cited

U.S. PATENT DOCUMENTS 4,249,265 A * 2/1981 Coester ..... 398/170
5,033,219 A * 7/1991 Johnson et al. ..... 42/115
5,299,277 A * 3/1994 Fujii ..... 388/815
5,359,779 A * 11/1994 Polk et al. ..... 42/115
5,584,137 A * 12/1996 Teetzel ..... 42/117
5,629,105 A * 5/1997 Matthews ..... 429/97
5,704,155 A * 1/1998 Primeau, IV ..... 42/114
5,742,251 A * 4/1998 Gerber ..... 342/45
5,758,448 A * 6/1998 Thummel ..... 42/114
5,966,226 A * 10/1999 Gerber ..... 398/108
6,196,702 B1 * 3/2001 Krietzman ..... 362/259
6,201,495 B1 * 3/2001 Lemelson et al. ..... 342/45
6,510,642 B2 * 1/2003 Riener ..... 42/70.11
6,578,311 B2 * 6/2003 Danielson et al. ..... 42/114
6,892,488 B1 * 5/2005 Serravalle ..... 42/113
7,188,978 B2 * 3/2007 Sharrah et al. ..... 362/396
7,308,202 B2 * 12/2007 Roes et al. ..... 398/108
2003/0029072 A1 * 2/2003 Danielson et al. ..... 42/114
2006/0026888 A1 * 2/2006 Cheng et al. ..... 42/146
2006/0242882 A1 * 11/2006 Liu ..... 42/146
2007/0236384 A1 * 10/2007 Ivtsenkov et al. ..... 342/45
2007/0277422 A1 * 12/2007 Ding ..... 42/146

* cited by examiner

*Primary Examiner*—Michael Carone
*Assistant Examiner*—Daniel J Troy
(74) *Attorney, Agent, or Firm*—McLane, Graf, Raulerson & Middleton, Professional Association

(57) ABSTRACT

The present disclosure relates to a flashlight apparatus including a base module having a mount adaptor mountable on a firearm, a reflector module removably attachable to the base module, a power source module removably attached to the base module, and a light source module removably attachable to the base module, the light source module including an illumination light source and a laser light source. In a further aspect, an identification friend or foe system is provided.

17 Claims, 8 Drawing Sheets

MODULAR FLASHLIGHT APPARATUS FOR FIREARM

SUMMARY

The present disclosure relates to a modular flashlight for firearm. In one aspect, a flashlight apparatus is provided including a base module having a mount adaptor mountable on a firearm, a power supply module removably attached to the base module, a reflector module removably attachable to the base module, and a light source module removably attachable to the base module, the light source module including an illumination light source and a laser light source.

In another aspect, an identification friend or foe system is provided, including a flashlight apparatus having a base module having a mount adaptor mountable on a firearm, a power supply module removably attached to the base, a reflector module removably attachable to the base module, and a light source module removably attachable to the base module. The light source module includes an illumination light source and a laser light source for emitting a first optical signal. An identification friend or foe unit of a type capable of emitting a second optical signal detectable to identify a user as a friend is remotely located from the flashlight apparatus. An optical receiver is coupled to the remotely located identification friend or foe unit and activates the remotely located identification friend or foe unit to cause the remotely located identification friend or foe unit to emit the second optical signal in response to receiving the first optical signal.

In another embodiment of both previously mentioned aspects, the light source module may be a variable light source module and may incorporate an LCD screen or LED display, allowing an operator to select from a variety of light source types, including, but not limited to any combination of: an LED, incandescent lamp, or laser, and may, include wavelengths in the visible and infrared (IR) regions.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
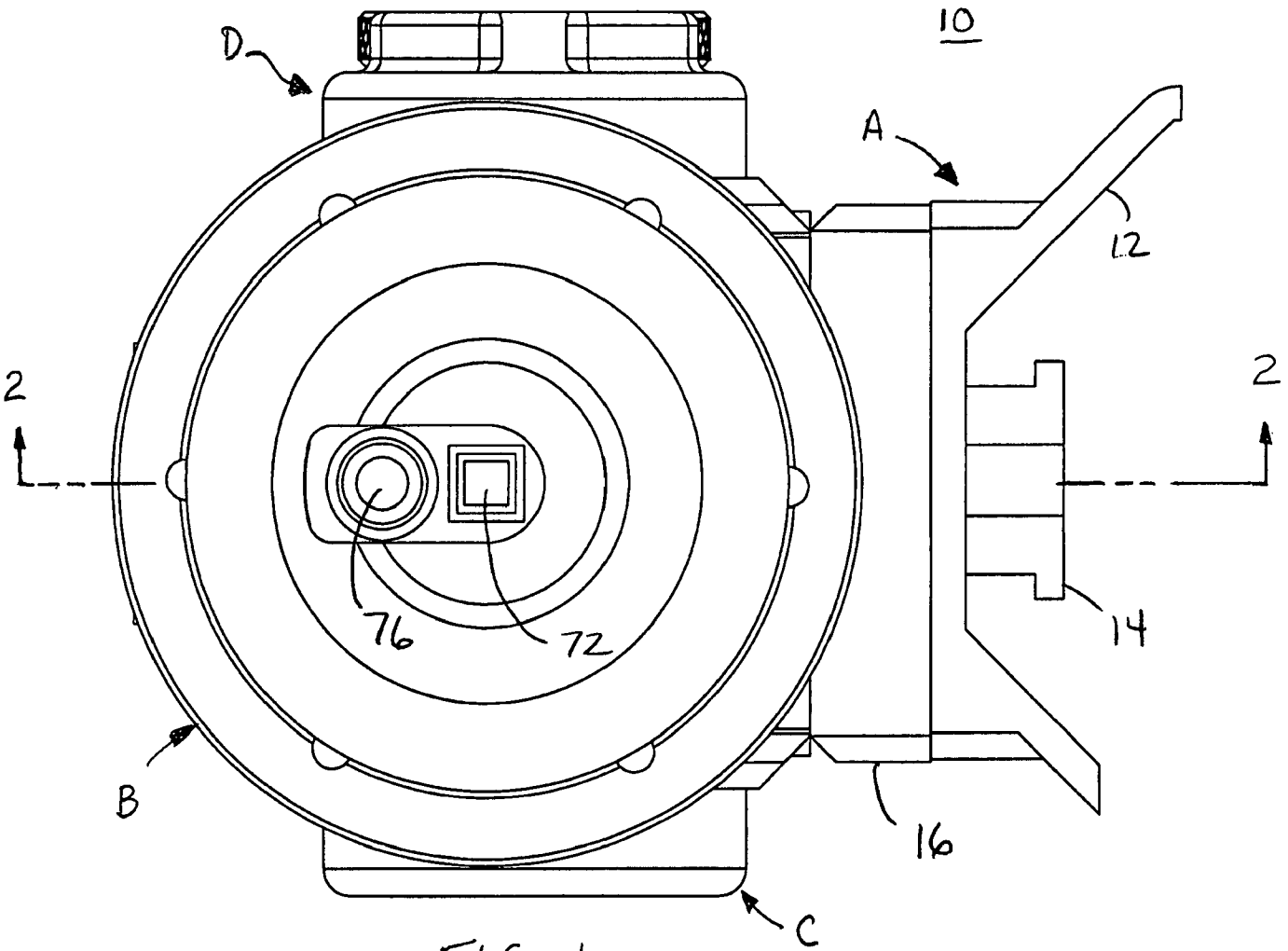
FIG. 1 is a front elevational view of an assembled modular flashlight embodiment herein.
Figure 2:
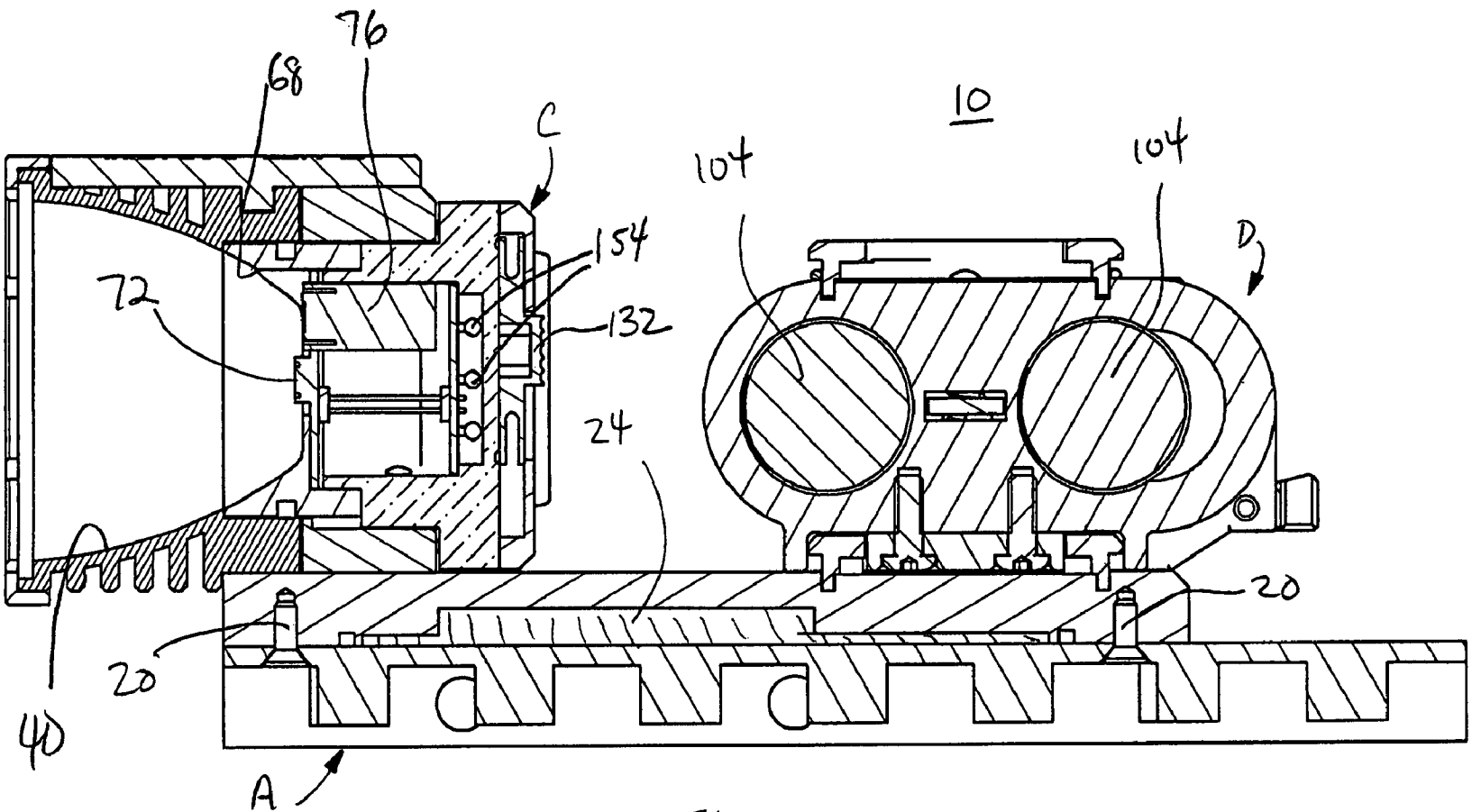
FIG. 2 is a cross-sectional view taken along the lines 2-2 in FIG. 1.
Figure 3:
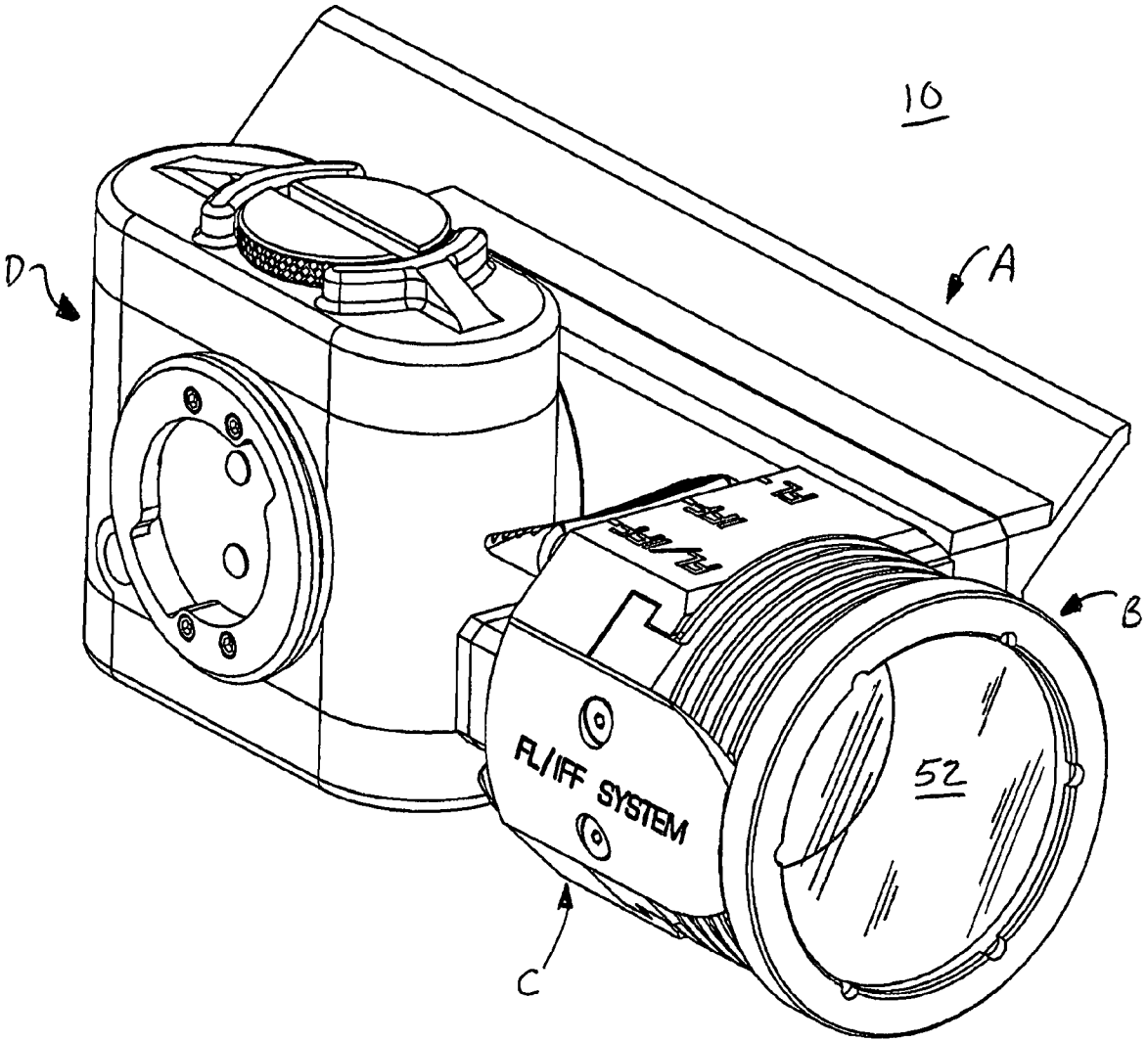
FIG. 3 is a front, top, and left side isometric view of the assembled modular flashlight embodiment shown in FIG. 1.
Figure 4:
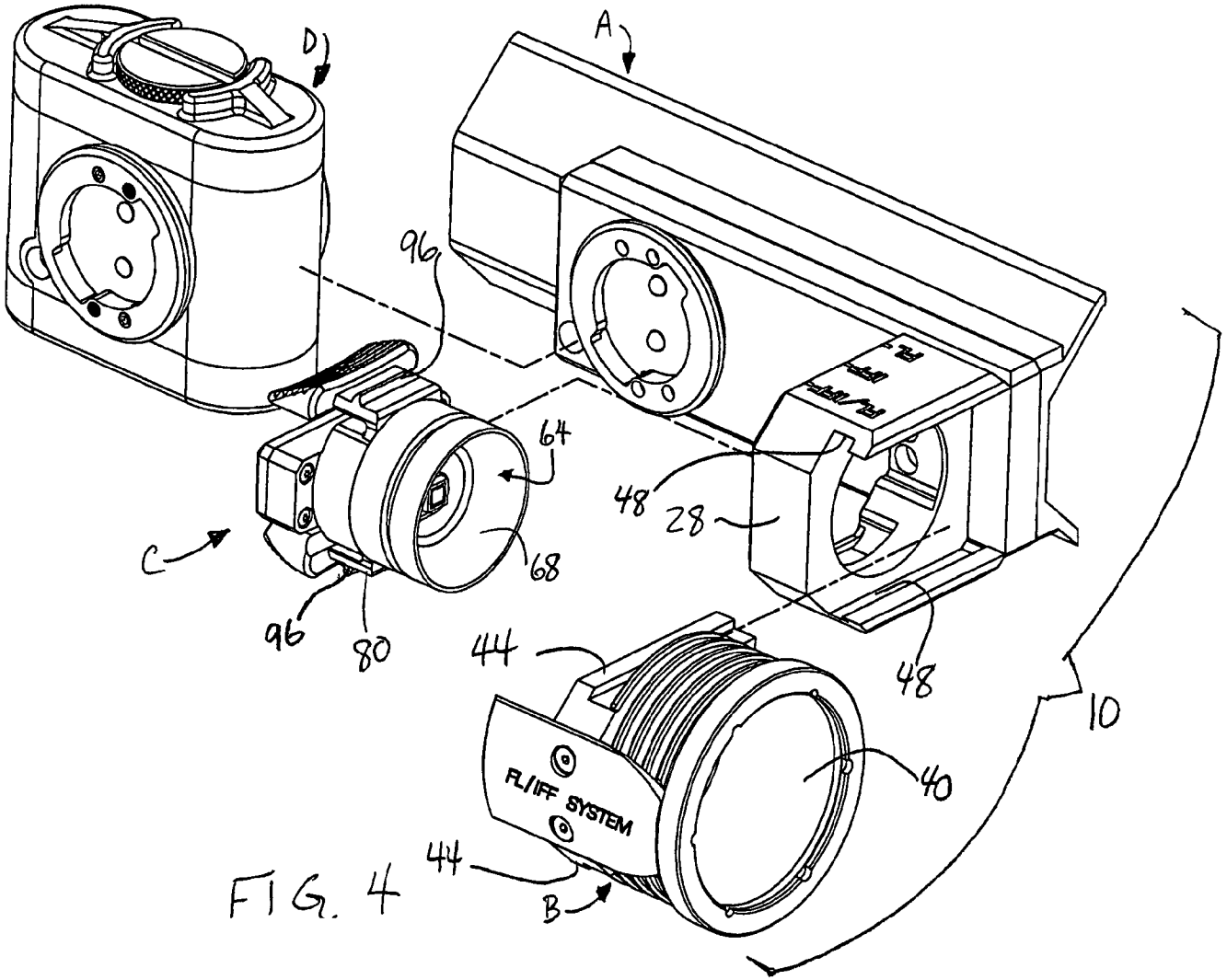
FIG. 4 is a front, top, and left side exploded isometric view of the disassembled modular flashlight embodiment shown in FIG. 1.
Figure 5:
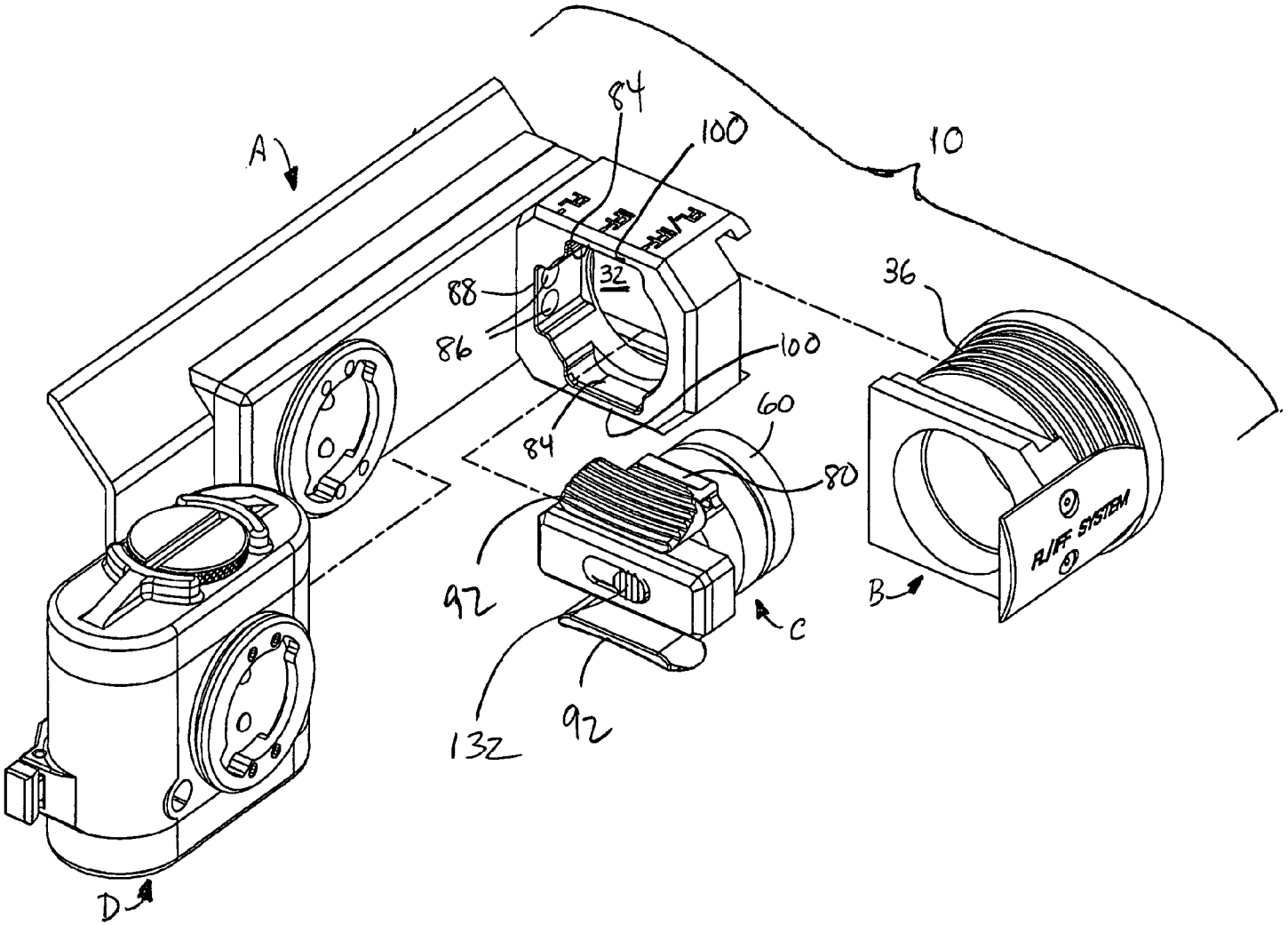
FIG. 5 is a rear, top, and left side exploded isometric view of the disassembled modular flashlight embodiment shown in FIG. 1.
Figure 6:
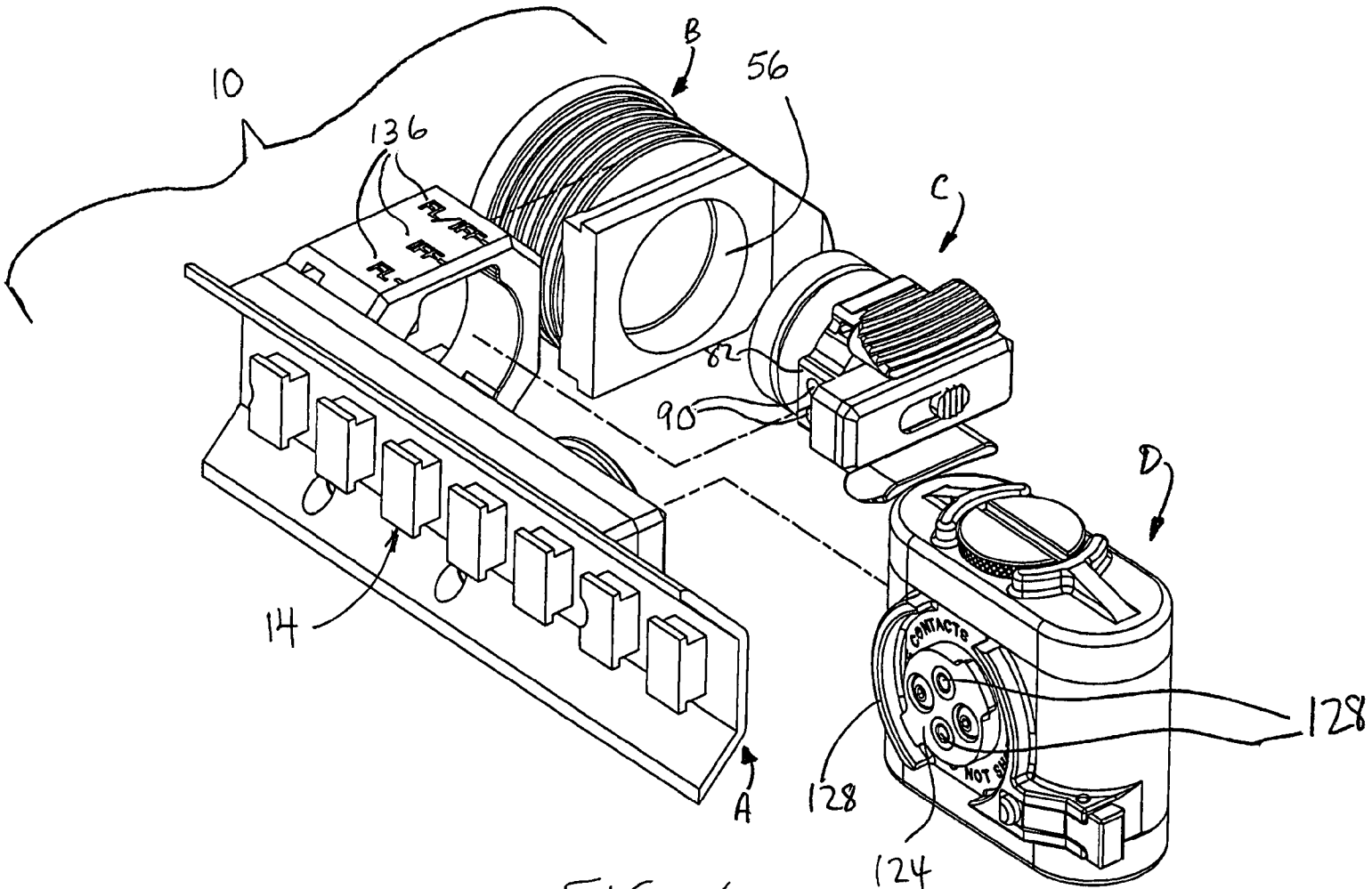
FIG. 6 is a rear, top, and right side exploded isometric view of the disassembled modular flashlight embodiment shown in FIG. 1.
Figure 7:
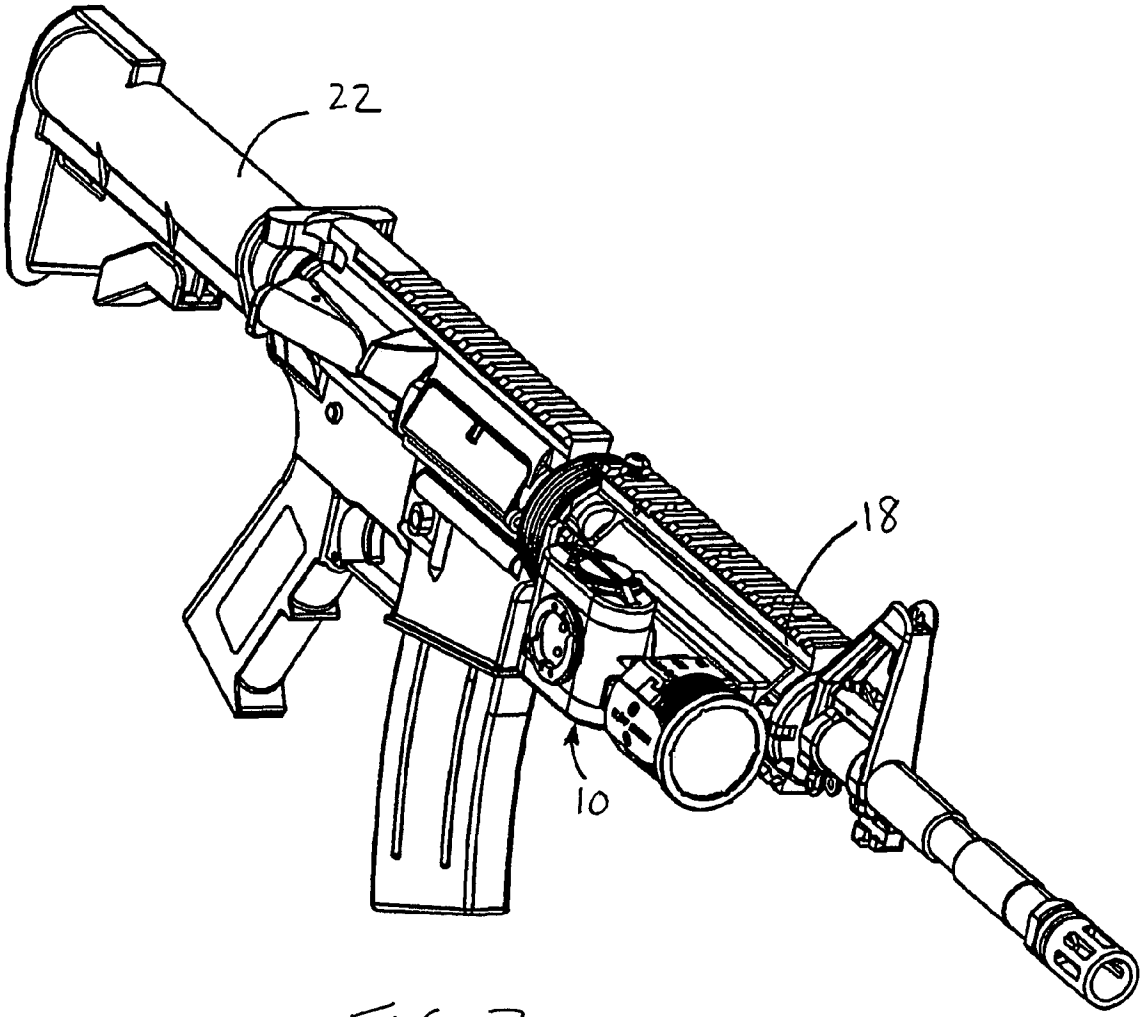
FIG. 7 is a pictorial illustration showing the embodiment of FIG. 1 attached to a firearm.

Referring to the drawing FIGS. 1-8 wherein like reference numerals refer to like components throughout the several views, a flashlight module 10 includes a modular base assembly A, a modular reflector assembly B, a modular light source assembly C, and a modular power supply assembly D.

The base assembly A includes a base member 12 adapted for mounting on an offensive weapon such as a military rifle, handgun, or the like. In a preferred embodiment, the base member 12 is adapted to be removably mounted to an accessory rail 18 of a military rifle 22. In an especially preferred embodiment, the base member 12 includes a mount 14 adapted to mount to a Picatinny rail interface (e.g., as specified in MIL-STD-1913). However, it will be recognized that the present invention may be adapted for use with all manner firearms, including without limitation rifles, handguns, machine guns, mortars, etc., and that the mounting system may be modified to accommodate other rail interface systems or weapon accessory mounting systems.

A circuit board housing member 16 is secured to the base 12, e.g., via threaded fasteners 20, and encloses a circuit board 24, such as a printed circuit board or other circuit-carrying substrate. The circuit board housing 16 includes an upstanding mounting ring 28 for removably receiving the modular reflector assembly B and the modular light source assembly C. The mounting ring 28 defines an aperture 32 extending therethrough.

The reflector assembly B includes an axially-extending sleeve portion 36 housing a first, concave reflector 40, e.g., a parabolic reflector for reflecting light from a light source located at or near the focal point in a substantially conical beam. The reflector assembly B further includes a pair of transversely-extending lips 44 which slidably and removably engage complimentary transverse grooves or channels 48 formed on the mounting ring 28. Optionally, a lens, filter, cap, or the like 52 may be provided on the sleeve 36 to prevent moisture, debris, or other environmental contamination from entering the interior portion of the reflector assembly B or to otherwise protect the light source from damage. A rear aperture or opening 56 defined in the reflector assembly B is adjacent to and axially aligned with the aperture 32 in the mounting ring 28 when the reflector assembly B is received on the mounting ring 28.

The light source module C includes an axially-extending sleeve portion 60 defining a cavity 64 housing a second reflector 68. A first light source 72 is mounted in the cavity 64 coaxial with the sleeve 60 and the second reflector 68. A second light source 76 is also housed within the cavity 64, adjacent the first light source 72.

When assembled, the sleeve portion 60 is received through the aperture 32 in the mounting ring 28 and the aperture 56 in the reflector assembly B. Preferably, the aperture 32 and the sleeve portion 60 are keyed or otherwise complimentarily shaped to ensure proper orientation of the light source module C within the mounting ring 28. For example, one or more protrusions or projections 80, 82 on the light source assembly C may be provided which mate with complimentary recesses 84, 88, respectively, in the mounting ring 28 (or vice versa). In the depicted preferred embodiment, the first reflector 40 and the second reflector 68 are aligned to provide a substantially continuous, convex (e.g., parabolic) reflector surface.

Electrical contacts 86 on the circuit board 24 extend through the circuit housing 16 within the aperture 32 and electrically couple the power supply module D to the light source module C via aligned electrical contacts 90 thereon.

One or more releasable latch or fastener devices may be provided to secure the light module C within the mounting ring 28. In the depicted embodiment, resilient or flexible tabs 92 on opposing sides of the light module C are provided with an upstanding rib or like protrusion 96. In assembled position, each of the ribs 96 is received within an aligned one of the recesses 84. Each of the ribs 96 abuts a radially inwardly-extending lip 100 on the mounting ring 28, thereby securing the light module C to the mounting ring 28. Furthermore, the sleeve member 60 is coaxially received within the aperture 56 of the reflector module B, thereby securing the reflector module B in place and preventing inadvertent removal of the reflector module B from the mounting ring 28.

In order to remove the light source module C from the mounting ring 28, the flexible tabs 92 are manually depressed inwardly until the protrusions 96 are moved to a position radially inward of the lips 100, at which time the light module C may be withdrawn from the aperture 32 in the mounting ring 28. After the light module C is removed from the mounting ring 28, the reflector assembly B may be slidably removed from the grooves 48 in the mounting ring 28.

In the depicted embodiment, the first light source 72 may be an illumination light source and the second light source 76 may be a laser light source, preferably laser diode. The power supply module D contains one or more batteries or battery packs 104 for supplying electrical power to the light sources 72 and 76 and is preferably of a type providing a speed load for quick change of batteries.

In the depicted embodiment, the power supply module D is removably affixed to the base module A via a bayonet type mounting system. A female power supply connector 108 on the base member A includes a keyhole shaped opening 112 and electrical contacts 116. A male power supply connector 120 includes a complimentary key-shaped member 124 and electrical contacts 128. In operation, the keyed member 124 is inserted into the opening 112 and the power supply module D is rotated relative to the base module A. The electrical contacts 116 couple the batteries 104 to the circuit board 24 to provide power to the light sources 72, 76 and any other control circuitry for controlling the optical output of the light sources 72 and 76, as described below.

One or more switches may be provided for powering on and off the device 10 and for selecting the light sources to be activated. In the depicted exemplary embodiment 10, a sliding switch mechanism 132 utilizing magnetic field energized reed switches 154 is provided on the light module C for selecting between an illumination source only mode, a laser source only mode and a combined illumination and laser source mode. Indicia 136 on the mounting ring 28 may be provided to identify the currently selected mode. A switch (not shown) may also be provided for powering the light module C on and off and is preferably a switch provided on or adjacent a hand grip member of or attached to an associated firearm and electrically coupled to the circuitry 24. Alternatively, an LCD screen or LED display (e.g., for numeric/character display) may be provided to allow for selection and/or display of light sources and encoded frequencies using a variety of selection input devices, such as a keypad or buttons, rotary switch, touch switch, momentary switch, knob, touch screen overlay, or the like.

The illumination source 72 may be of any desired wavelength or wavelengths, including wavelengths in the visible and infrared (IR) regions. The illumination source 72 may be used for example, as a target illuminator, tactical light, or the like. The light source 72 may, for example, be one or more incandescent (including halogen) lamps or light-emitting diode (LED) light source, and may be comprise one or more illumination elements located at or near the focal point of the reflector surface defined by the first and second reflectors 40 and 68 to generate a conical light pattern. The modular nature of the unit 10 makes it possible to replace the illumination module C with another module having a illumination light source 72 of a desired wavelength.

Figure 8:
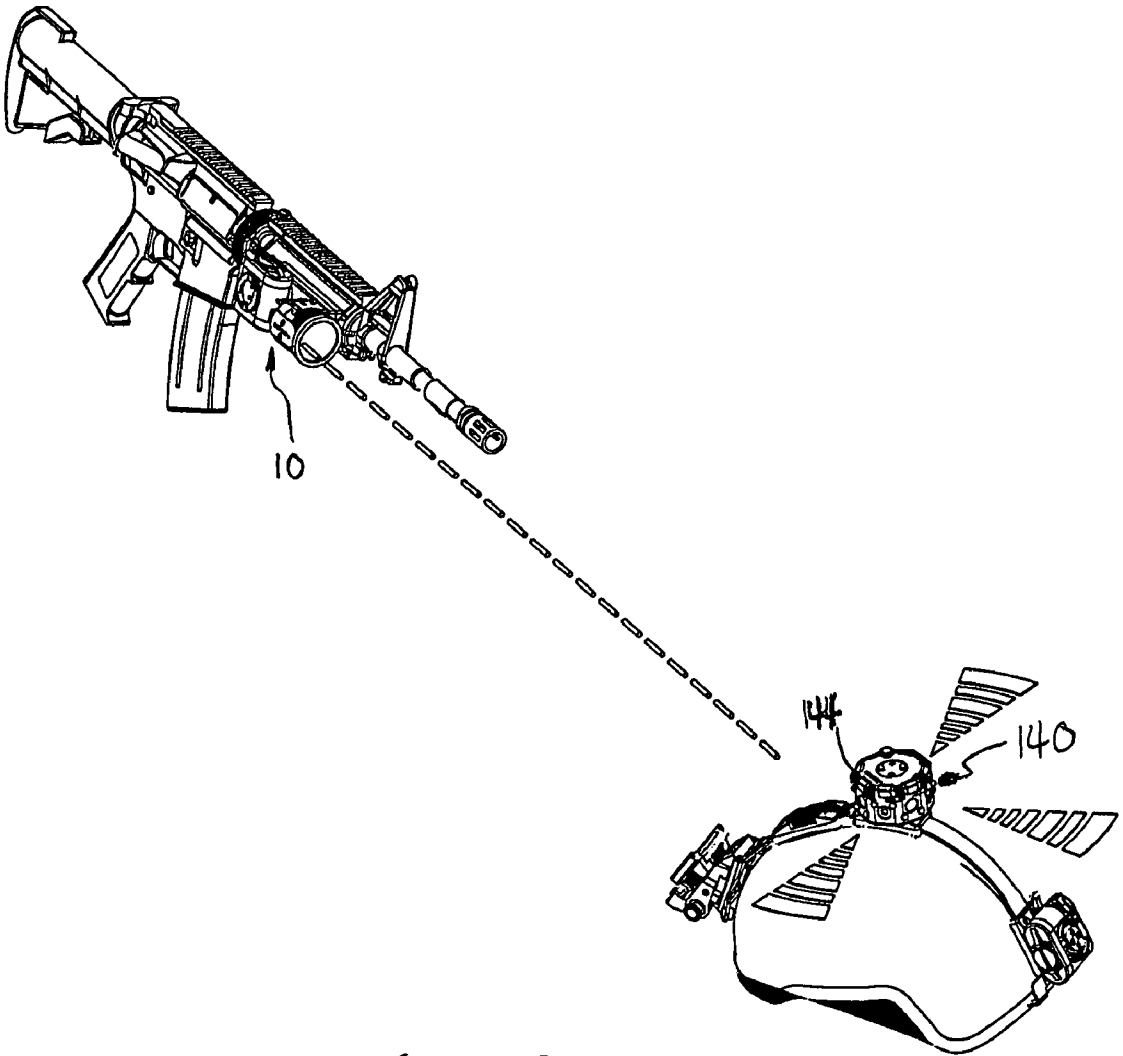
FIG. 8 is a schematic diagram illustrating an identification friend or foe system according to a further aspect.

The laser source 76 may advantageously be used to send an optical control signal to a remotely-controllable device having an optical receiver. In a particularly preferred embodiment, the laser source 76 is adapted to control a remotely located identification friend-or-foe (IFF) emitter of a type used for combat identification to distinguish friend from foe and thereby avoiding friendly fire casualties. IFF units, such as wearable units (e.g., helmet-mounted units), which emit an optical signal, such as a visible or IR optical signal, may be used to identify friendly combatants. Commonly, such units are passive optical emitters and cannot be interrogated. Thus, such units are incapable of identifying friendly combatants if the user has powered off the unit or if the unit is otherwise turned off or in a dormant state. Thus, the present development contemplates providing an optical IFF unit with an optically-operated power or reset switch for activating an IFF unit that is dormant or otherwise turned off. An exemplary IFF system including the flashlight apparatus 10 and a remotely located IFF unit 140 having an optical receiver 144 is illustrated in FIG. 8. The optical receiver 144 may be positioned on the IFF unit 140 so as to provide a wide coverage angle, preferably a 360-degree coverage angle. Likewise multiple receivers 144 may be provided so as to provide the desired coverage angle.

In certain embodiments the laser source 76 may be adapted for use used in conjunction with optical receiver circuitry 144 on the remotely located IFF unit 140 which can be can activated via the application of optical radiation to a photoresistor, phototransistor, or the like, and appropriate amplification circuitry to amplify, or other circuitry as needed to obtain a desired sensitivity and to perform the desired function or powering on or activating an IFF unit.

In other embodiments, the flashlight device 10 preferably additionally includes encoder circuitry for causing the laser source 76 to output an encoded optical output signal, such as a pulse encoded binary optical signal. The encoder circuitry may be provided on the circuit board 24 or, alternatively, may be housed within the illumination module C. In such embodiments, the optical detectors on the remotely located IFF units preferably employ a decoder for decoding the encoded optical signal. In this manner, activation of the remote IFF units may be initiated by logic-controlled circuitry and is programmable. In this manner, a number of other commands in addition to activating or powering on the remote IFF units may be provided as well. Furthermore, the use of encoded signals provides security against inadvertent or malicious tampering with the remotely located IFF units. The modular nature of the device 10 makes it possible to periodically, and in coordination with changes in the remotely activated IFF units, replace the light source module C with another module having a laser source 76 of a different wavelength and/or different optical encoding.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A modular flashlight apparatus, comprising:

a base module having a housing and a mount adaptor on a first side of said housing for removably mounting said flashlight apparatus to a firearm;

an upstanding mounting ring attached to a second side of said housing;

a reflector module removably attached to said mounting ring;

a light source module removably attached to said mounting ring, said light source module including an illumination light source;

said light source module attachable to and removable from said mounting ring without removal of said reflector module from said mounting ring; and said light source module including a laser light source generating an encoded optical signal.

2. The modular flashlight apparatus of claim 1, further comprising:

a power supply module removably attached to said base module, said power supply module including a housing defining a battery compartment; and circuit components for electrically coupling said power supply module and said light source module.

3. The modular flashlight apparatus of claim 1, further comprising:

said illumination light source including one or more light elements, each light element selected from among an LED, an incandescent lamp, and combinations thereof.

4. The modular flashlight apparatus of claim 1, further comprising:

said illumination light source selected from a visible light source, an IR light source, or combinations thereof.

5. The modular flashlight apparatus of claim 1, further comprising:

said laser light source selected from one or more visible laser light sources, IR laser light sources, or a combination thereof.

6. The modular flashlight apparatus of claim 1, further comprising:

a selector switch for selectively switching between said illumination light source, said laser light source, or both.

7. The modular flashlight apparatus of claim 1, wherein the encoded optical signal is a pulse-encoded binary signal.

8. The modular flashlight apparatus of claim 1, further comprising:

a switch electrically coupled to the power supply module for selectively powering on and off the flashlight apparatus.

9. The modular flashlight apparatus of claim 1, further comprising:

said light source module including a variable light source having a plurality of light sources selected from one or more light-emitting diodes, one or more incandescent lamps, one or more laser light sources, and any combinations thereof.

10. The modular flashlight apparatus of claim 9, further comprising:

said plurality of light sources selectable to produce light having a wavelength in a visible region, an IR region, or combinations thereof; and a display for selectively activating each one or more of said plurality of light sources.

11. The modular flashlight apparatus of claim 1, further comprising:

said reflector module including features that slidingly engage grooves formed on said mounting ring to define a tongue-and-groove sliding engagement between said reflector module and said mounting ring.

12. The modular flashlight apparatus of claim 11, further comprising:

said light source module including one or more fasteners for selectively and removably securing the light source module to said mounting ring, said light source module attachable to and removable from the mounting ring without removal of the reflector module from said mounting ring.

13. The modular flashlight apparatus of claim 12, further comprising:

said light source module including a sleeve removably received within a complimentary aperture in said reflector module to secure said reflector module to said mounting ring when said light source module and said reflector module are attached in an operable position on said mounting ring.

14. An identification friend or foe system, comprising:

a flashlight apparatus having a base module having a housing and a mount adaptor on a first side of said housing for removably mounting said flashlight to a firearm; an upstanding mounting ring attached to a second side of said housing; a reflector module removably attached to said mounting ring; and a light source module removably attached to said mounting ring including a laser light source for emitting an optical signal and illumination light source; wherein said light source module is attachable to and removable from the mounting ring without removal of said reflector module from said mounting ring;

an identification friend or foe unit operable to emit a second optical signal which is detectable to identify a user as a friend; and an optical receiver coupled to said identification friend or foe unit for receiving said first optical signal and to activate said identification friend or foe unit and cause said identification friend or foe unit to emit said second optical signal in response to receiving said first optical signal.

15. The identification friend or foe system of claim 14, wherein the identification friend or foe unit is remotely located from said flashlight apparatus.

16. The identification friend or foe system of claim 14, further comprising:

said laser light source selected from one or more visible laser light sources, IR laser light sources, or a combination thereof.

17. The identification friend or foe system of claim 14, wherein said first optical signal is selected from an encoded optical signal and a pulse-encoded binary optical signal.

* * * * *